US007267433B2

(12) United States Patent
Steiner

(10) Patent No.: US 7,267,433 B2
(45) Date of Patent: Sep. 11, 2007

(54) METHOD FOR CONDITIONING INKJET FLUID DROPLETS USING LAMINAR AIRFLOW

(75) Inventor: Thomas W. Steiner, Burnaby (CA)

(73) Assignee: Eastman Kodak Company, Rochester, NY (US)

( * ) Notice: Subject to any disclaimer, the term of this patent is extended or adjusted under 35 U.S.C. 154(b) by 333 days.

(21) Appl. No.: 11/088,771

(22) Filed: Mar. 25, 2005

(65) Prior Publication Data

US 2005/0190242 A1 Sep. 1, 2005

Related U.S. Application Data

(63) Continuation-in-part of application No. 10/602,819, filed on Jun. 25, 2003, now Pat. No. 6,984,028.

(51) Int. Cl.
*B41J 2/07* (2006.01)

(52) U.S. Cl. ..... 347/74

(58) Field of Classification Search ..... 347/74, 347/73, 75–83, 21
See application file for complete search history.

(56) References Cited

U.S. PATENT DOCUMENTS 3,596,275 A 7/1971 Sweet
3,836,913 A 9/1974 Burnett et al.
3,955,203 A 5/1976 Chocholaty
3,972,051 A * 7/1976 Lundquist et al. ..... 347/74
4,097,872 A 6/1978 Giordano et al.
4,292,640 A * 9/1981 Lammers et al. ..... 347/21
4,297,712 A 10/1981 Lammers et al.
6,572,223 B2 6/2003 Delametter et al.

FOREIGN PATENT DOCUMENTS

EP 1 319 510 A1 6/2003
JP 55126465 9/1980
JP 58 005265 1/1983

OTHER PUBLICATIONS

European Patent Office; Examiner M. Bardet; European Search Report; Sep. 24, 2004.

* cited by examiner

*Primary Examiner*—K. Feggins

(57) ABSTRACT

A multirow multinozzle continuous inkjet head comprises a plurality of rows of inkjet nozzles ejecting drops in regions of airflow velocity within a collinear flow of air. The airflow velocity at all nozzles is equal, but lower than the highest airflow velocity within the collinear flow of air. This allows many more drop streams to be placed in a velocity-matched airstream. Despite the drops being in regions with air velocity gradients across the drops, the lateral forces are such that droplet placement on the print media surface is accurate and well controlled.

40 Claims, 2 Drawing Sheets

METHOD FOR CONDITIONING INKJET FLUID DROPLETS USING LAMINAR AIRFLOW

RELATED APPLICATIONS

This application is a continuation-in-part of U.S. patent application Ser. No. 10/602,819 filed 25 Jun. 2003 now U.S. Pat. No. 6,984,028 which is hereby incorporated herein by reference.

TECHNICAL FIELD

The invention pertains to the field of inkjetting of fluids and, in particular, to the conditioning of fluid droplets using laminar airflow

BACKGROUND

The use of ink jet printers for printing information on a recording media is well established. Ink jet printers may be grouped into "continuous" inkjet printers that use continuous streams of fluid droplets and "drop-on-demand" inkjet printers that emit droplets only when corresponding information is to be printed. Drop-on-demand inkjet printers have become the predominant type of printer for use in home computing systems, while continuous inkjet systems find major application in industrial and professional environments.

Continuous inkjet printers typically have a print head that incorporates a supply line or system for ink fluid and a nozzle plate with one or more ink nozzles fed by the ink fluid supply. A gutter assembly is positioned downstream from the nozzle plate in the flight path of ink droplets to be guttered. The gutter assembly catches ink droplets that are not needed for printing on the recording medium.

In order to create the ink droplets, a drop generator is associated with the print head. The drop generator influences, by any of a variety of mechanisms discussed in the art, the fluid stream within and just beyond the print head. This is done at a frequency that forces thread-like streams of ink, which are initially ejected from the nozzles, to break into a series of ink droplets in the vicinity of the nozzle plate. A charge electrode is positioned along the flight path of the ink droplets. The charge electrode selectively charges the ink droplets as the droplets break off from the jet. One or more deflection plates positioned downstream from the charge electrodes deflect a charged ink droplet either into the gutter or onto the recording media. For example, the droplets to be guttered are charged and hence deflected into the gutter assembly and those intended to print on the media are not charged and hence not deflected. In some systems, the arrangement is reversed, and the uncharged droplets are guttered, while the charged ones ultimately are printed.

Ink droplet misregistration at the media surface is a problem experienced by continuous ink jet printers. Interactions between droplets as they are propelled along a flight pathtowards the recording surface can cause ink droplet misregistration. One cause for droplet interaction is the aerodynamic drag on droplets. Unless the air velocity matches the drop velocity, local airflow around each drop is affected by the passage of the drop and this will affect the dynamics of trailing drops. Such aerodynamic interactions influence the relative spacing between droplets because they either increase or decrease the velocity of the droplets. As a result, some ink droplets reach the media early while others reach the media late. Drops may even merge in flight. The trailing drops may also experience lateral forces when following a drop on a different deflected trajectory. The overall effect is that the aerodynamic interaction, also called the aerodynamic drag, causes relatively poor printing quality due to droplet misplacement on the media.

In multinozzle print heads aerodynamic drag creates the additional problem of variation in droplet velocity from fluid droplet stream to fluid droplet stream, resulting in further inaccuracies in droplet placement on the media, and consequent poor printing quality.

To address the aerodynamic interaction problem, the prior art utilizes a gas stream, such as air, to compensate for aerodynamic drag on the ink droplets. The air flows collinearly with the stream of ink droplets and reduces the aerodynamic effect. The inkjet nozzle is generally mounted to eject the droplets into the center of the air stream. In an extension of this approach, laminar airflow has also been applied to multinozzle heads. This is generally done by using a single row of nozzles.

The prior art is generally characterized by the placement of a single nozzle centrally in the highest velocity zone of the laminar airflow column. This is done to minimize any forces that may deviate the flight path of the droplets laterally. Laminar flow systems for single rows of multiple inkjet nozzles have also been described in the prior art, the nozzles again being placed centrally in the highest velocity zone of the laminar airflow column. While multirow multinozzle continuous inkjet systems have indeed been proposed, they have not seen the benefit of laminar airflow, due to the above anticipated negative consequences of droplet placement anywhere but in the uniform highest airflow velocity area of the system where the airflow velocity profile is suitably flat. As a result, the inkjet printer designs suggested for multirow multinozzle systems are subject to serious droplet misregistration problems.

SUMMARY OF THE INVENTION

This invention provides printing methods and apparatus in which fluid droplets are introduced into an airflow outside of a region of maximum airflow velocity. The airflow may have a velocity gradient in the regions where the fluid droplets are introduced. Surprisingly droplet placement on the print media surface can be accurate and well controlled in such methods and apparatus.

One aspect of the invention provides methods for depositing fluid droplets on a surface. The fluid droplets may be ink droplets for example. The surface may be the surface of a medium to be printed on for example. The methods comprise establishing a flow of air in a first direction substantially collinear with a trajectory of fluid droplets emitted by each of one or more droplet emitters. The droplet emitters may be inkjet nozzles, for example. The flow of air has a velocity profile characterized by a maximum airflow velocity. The methods include emitting at least one fluid droplet from each of the droplet emitters into a first region of the flow of air. The droplet follows the trajectory onto the medium. The first region is spaced apart from a location of the maximum airflow velocity in a direction transverse to the first direction and the first region has a first regional airflow velocity lower than the maximum velocity.

The method may involve substantially matching a velocity at which the at least one fluid droplet is emitted into the first region with the first regional airflow velocity. Emitting at least one fluid droplet from each of the droplet emitters into the first region may comprise emitting fluid droplets from a plurality of nozzles into the first region. The method may involve emitting at least one fluid droplet from a first nozzle into the first region and emitting at least one additional fluid droplet from a second nozzle into a second region of the flow of air, the second region having a second regional airflow velocity that is also lower than the maximum airflow velocity. At least a portion of the first region and at least a portion of the second region may be on opposed sides of the location of the maximum airflow velocity.

Another aspect of the invention provides apparatus for depositing fluid droplets on a surface. The apparatus comprises an airflow duct and means for establishing in the duct a collinear airflow in a first direction. The collinear airflow has an airflow velocity profile with a maximum airflow velocity and a first region transversely spaced apart from a location of the maximum airflow velocity in a direction transverse to the first direction. The collinear airflow has a first regional airflow velocity in the first region which is lower than the maximum airflow velocity. The apparatus also comprises at least one nozzle disposed to emit fluid droplets into the first region in the first direction.

The apparatus may also comprise a systems controller configured to at least substantially match a fluid droplet velocity of the emitted fluid droplets and the first regional airflow velocity. The collinear airflow may also have a second region wherein the collinear airflow has a second regional airflow velocity which is also lower than the maximum airflow velocity. The apparatus may comprise a first group of one or more nozzles disposed to emit fluid droplets into the first region in a first direction and a second group of one or more nozzles disposed to emit fluid droplets into the second region in the first direction. At least a portion of the first region and at least a portion of the second region may be located on opposing sides of the location of the maximum regional airflow velocity.

Apparatus according to some embodiments of the invention includes first and second rows of nozzles disposed symmetrically on either side of the maximum airflow velocity of the velocity profile. Each of the rows of nozzles emits droplets into a corresponding region of the collinear airflow wherein the flowing air has a regional airflow velocity which is lower than the maximum airflow velocity.

In some embodiments, a multirow multinozzle continuous inkjet head comprises a plurality of rows of inkjet nozzles ejecting fluid droplets in regions of airflow velocity within a collinear flow of air. The airflow velocity at all droplet trajectories is substantially equal, but lower than the highest airflow velocity within the collinear flow of air. This allows many more droplet streams to be placed in a velocity-matched airstream. Despite the droplets being in regions with air velocity gradients across the droplets, it is found that the lateral forces are such that droplet placement on the print media surface is accurate and well controlled.

BRIEF DESCRIPTION OF DRAWINGS

In drawings which illustrate non-limiting example embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
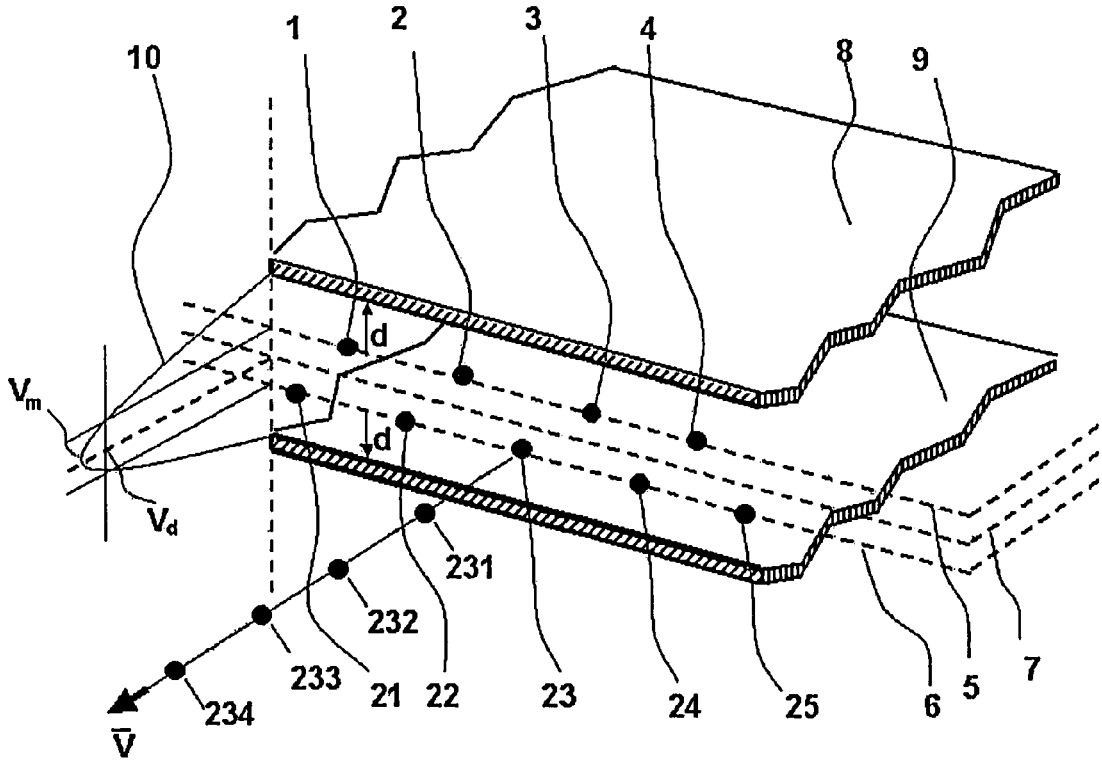
FIG. 1 shows inkjet fluid droplets moving collinearly within a column of air that has a velocity distribution that is symmetrical with respect to a plane within the column; and, FIG. 2 shows inkjet fluid droplets moving collinearly within a column of air that has a velocity distribution that is cylindrically symmetrical with respect to a line down the centre of the column.

FIG. 1 shows a preferred embodiment of the invention. Inkjet fluid droplets 1, 2, 3 and 4 are moving in plane 5 in the direction of vector v, as indicated by the arrow, at an equal distance d from plate 8. Inkjet fluid droplets 21, 22, 23, 24 and 25 are moving collinearly with inkjet fluid droplets 1, 2, 3 and 4 in plane 6 in the direction of vector v, as indicated by the same arrow, at an equal distance d from plate 9. A substantially collinear flow of air is established by forcing air to flow substantially collinearly with both rows of droplets in the direction of vector v, as indicated by the arrow. The inkjet fluid droplets are emitted from inkjet nozzles into the collinear flow of air. In the substantially collinear air flow, the airflow is approximately aligned in direction with the path of the drop over the majority of the course of its flight from ejection to deposition on the recording surface, to the degree that when speeds are approximately matched over the path, the relative velocity of air and drop is sufficiently small to reduce aerodynamic drag effects on the drop, such that drop placement accuracy on the printed surface is measurably improved.

Since the various technologies of inkjet fluid droplet emission are well-known to those skilled in the art, they are not discussed further here and the nozzles are not shown in the figures. The systems controller or controllers that may be provided to control the velocity of the emitted inkjet fluid droplets, as well as the airflow in the laminar airflow duct, are also well-known to those skilled in the art. They are therefore not shown in the figures and are not further discussed herein.

The four inkjet fluid droplets of the first row and the five inkjet fluid droplets of the second row are chosen to be representative of a much larger number of droplets moving in exactly the same fashion. For the sake of clarity each train of inkjet fluid droplets moving between the two plates 8 and 9 is represented by a single droplet in FIG. 1, whereas, in fact, each train is comprised of many droplets traveling one behind the other. One of the trains of inkjet fluid droplets, that of which inkjet fluid droplet 23 is part, is shown to comprise inkjet fluid droplets 23, 231, 232, 233 and 234.

To the extent that plates 8 and 9 both extend much further in all directions of their planes, the airflow velocity profile is described by curve 10. Plates 8 and 9 are combined with further plates, not shown in FIG. 1 to constitute a defined space within which the collinear flow of air is established. This defined space functions as a collinear airflow duct. A maximum airflow velocity $v_m$ is obtained halfway between plates 8 and 9, and the airflow velocity profile is symmetrical about this halfway point given by plane 7. The airflow velocity profile is determined by a number of factors. Chiefly, the controlling boundary condition is that the velocity will be zero at the inner surfaces of planes 8 and 9 and will increase towards the halfway point. Furthermore, the dimensions and velocity must be such that the resulting Reynolds number is low enough to allow purely laminar flow.

Suitable means for injecting and charging inkjet fluid droplets, as well as suitable means for establishing a collinear flow of air, and ensuring that the airflow velocity in the vicinity of the droplets and the droplet velocity are substantially matched, are all well known in the art and will not be further discussed herein. The matching of these velocities may be accomplished by adjusting the droplet velocity, or the regional airflow velocity, or both.

In the prior art, inkjet nozzles would be positioned such that the droplets travel precisely halfway between plates 8 and 9 in the maximum airflow velocity region given by plane 7, where the curve peaks. Within this small region, the airflow velocity profile is substantially flat and the inkjet fluid droplets are considered stable in their paths. The substantially flat region of the velocity profile occurs where small variations in velocity exist across the drop for nominal positions around the peak, such that for small variations in position of the stream in said substantially flat region of the velocity profile, insignificant aerodynamic forces are acting upon the drop stream.

A designer wishing to make a continuous inkjet printer that has more than one row of nozzles is confronted by the fact that a plurality of rows cannot all be in the maximum airflow velocity region of plane 7. If the rows are not in that region, then, because of the airflow velocity profile, they have to be in areas where the airflow velocity actually varies significantly over the dimensions of a single droplet. The droplets would experience a faster airflow speed at their inner surfaces than at their outer surfaces. "Outer surface" is used herein to describe the surface of the inkjet fluid droplet facing away from the region of highest airflow velocity. Conversely, "inner surface" is used herein to describe the surface of the inkjet fluid droplet that faces toward the highest airflow velocity region. By way of example, the outer surfaces of inkjet fluid droplets 4 and 24 face away from plane 7, while the inner surfaces of inkjet fluid droplets 4 and 24 face toward plane 7. This variation in airflow velocity across an inkjet fluid droplet will cause the drops to spin and be subject to lateral forces that may prevent drops from being directed to the gutter or cause misregistration on the printed media.

The inventors have found that drop-to-drop aerodynamic interactions can be reduced to negligible levels while lateral forces, although present, are such that droplet placement on the print media surface is accurate and well controlled. By ensuring that the two rows of inkjet fluid droplets are at the same distance from plates 8 and 9 respectively, the droplets are emitted into regions of the collinear flow of air where the regional airflow velocities at the droplets are at substantially the same value $v_d$, which is specifically lower than the maximum airflow velocity $v_m$.

In some preferred embodiments of the invention, shown in FIG. 1, the spacing between the plates 8 and 9 is typically in the range of 200 to 400 microns. The acceptable range for the spacing between the plates 8 and 9 is determined by multiple factors. The minimum spacing between the plates 8 and 9 should be sufficiently large to allow the placement of two separated rows of nozzles with a gap, d, between each row and its adjacent plate. The separation between the two rows of nozzles is also chosen to reduce undesirable drop-to-drop interaction effects that may occur in multi-row inkjet arrays. The plates should be spaced closely enough to ensure the development of laminar airflow between plates 8 and 9.

Whether flow within the duct will be laminar is dependent upon the Reynolds number associated with the system. The Reynolds number is derived from various parameters including the dimensions of the duct, the average velocity, and the viscosity and the density of the air in the duct. The conditions for laminar airflow are typically found with Reynolds numbers below 1000. The length of the plates may be on the order of several centimeters or greater depending on the lengths of the rows of nozzles. The distance d separating the train of droplets from the adjacent plate may vary from a few microns to tens of microns. In this preferred embodiment, the distance d from either row of nozzles to its adjacent plate is 50 microns. The rows of nozzles are separated by 250 μm to produce a duct with a total gap width of 350 μm. The height of the duct in the direction indicated by the train of droplets 231 to 234 may be on the order of several millimeters.

In this preferred embodiment, the maximum airflow, $V_m$, at the centre of the duct is 45 meters per sec. The laminar profile of the airflow will reduce the airflow velocity at planes 6 and 7. In this preferred embodiment, the reduced airflow velocity at planes 6 and 7 is 30 meters per sec and matches the droplet velocity of the droplets in each row, $V_d$. Air velocities at the maximum of the laminar flow profile can range from a few tens of meters per sec to over 100 meters per sec, with distance d chosen to match sub-maximal air velocities in the airflow profile at droplet velocities that can typically range from 10 to 50 meters/sec in inkjet printing devices. In this preferred embodiment of a two-row nozzle system, both rows of nozzles are equally spaced and centrally positioned within the duct to ensure that the each row of nozzles emits fluid droplets into airflow regions that have substantially the same airflow velocity. The rows of nozzles need not however be positioned directly above one another but can be staggered as shown in FIG. 1 to double the printing resolution that may be obtained in comparison with a single row of nozzles.

Figure 2:
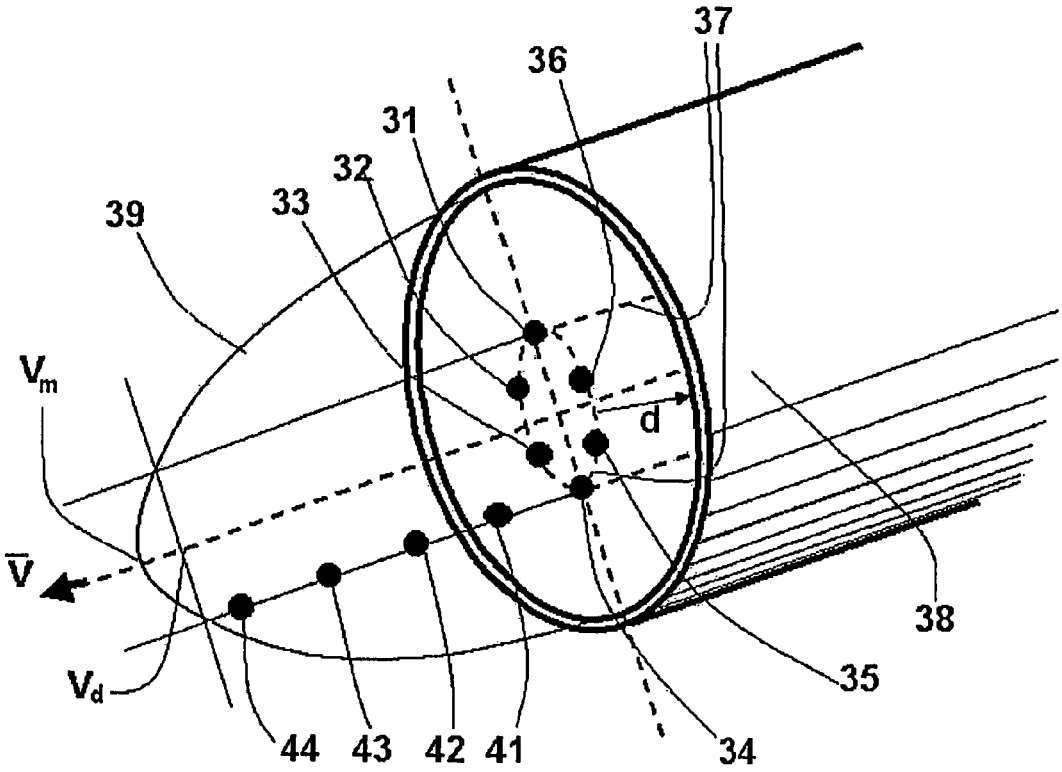

In a further embodiment of the invention, shown in FIG. 2, inkjet fluid droplets 31, 32, 33, 34, 35 and 36 are moving in the direction of vector v, as indicated by the arrow, within cylindrical surface 37 at a radial distance d from cylinder 38. Air is forced to flow collinearly with the inkjet fluid droplets within the defined space defined by a collinear airflow duct in the form of cylinder 38 in the direction of vector v, as indicated by the arrow. The inkjet fluid droplets are therefore emitted into a region of the collinear flow of air that is defined by a thin cylindrical shell of air, cylindrically symmetric with the cylinder 38 and of radius that is smaller than that of cylinder 38 by an amount d. In this particular case, the six inkjet fluid droplets are chosen to be representative of a potentially different number of droplets moving in exactly the same fashion within the same selected air region where they travel collinearly at substantially the same regional airflow velocity $V_d$, which is less than the maximum airflow velocity $v_m$. For the sake of clarity, each train of inkjet fluid droplets is represented by a single droplet in FIG. 2, whereas, in fact, each train is comprised of many droplets traveling one behind the other. One of the trains of inkjet fluid droplets, that of which inkjet fluid droplet 34 is part, is shown to comprise inkjet fluid droplets 41, 42, 43, 44 and 45.

The airflow velocity profile is described by curve 9 and the air at the center of the cylinder flows at the maximum airflow velocity $v_m$. The airflow velocity profile is determined by the fact that the velocity will be zero at the inner surface of cylinder 8 and will increase towards the center of the cylinder. The inkjet fluid droplets are therefore traveling in a region that has an airflow velocity distinctly smaller than the maximum airflow velocity.

In the prior art, this laminar flow configuration could only be employed for use with a single train of inkjet fluid droplets moving precisely down the center of the cylinder in the maximum airflow velocity zone. Within this small region, the prior art considered the velocity profile suitably flat and the inkjet fluid droplets were considered stable in their paths.

It is clear that, in a more generalized embodiment, the cross-section of the defined space, perpendicular to the collinear flow of air, may have a random two-dimensional shape. There will be a distinct airflow velocity profile. It will always be possible to select regions in which the regional airflow velocity is equal, but lower than the maximum airflow velocity. A plurality of rows of inkjet nozzles may be placed to emit inkjet fluid droplets into the region or regions of equal regional airflow velocity.

The case of a cylindrical cross-section is merely a very special case in which these regions assume the shape of a cylindrical shell. In the general case of the present invention, the term "outer surface" describes that surface of an inkjet fluid droplet that faces away from the highest airflow velocity region within the collinear airflow duct. The term "inner surface" describes that surface of an inkjet fluid droplet that faces towards the highest airflow velocity region within the collinear airflow duct. Since the timing of the emission of inkjet fluid droplets into the selected air regions is at the discretion of the designer, it may be selected such as to ensure that a given inkjet fluid droplet will deposit onto the media being printed upon at exactly the desired point at the desired time. This allows an entirely generalized distribution of nozzles to be employed to print the required information with correct registration. In this embodiment of the present invention, the arrangement of nozzles may, in general, be non-linear and non-circular.

In a further embodiment of the invention, most easily described at the hand of a cylindrical system, two or more regional airflow velocities are selected, and inkjet fluid droplets are emitted into these different regions at velocities substantially matched with the respective regional airflow velocities. In the case of a cylindrically shaped laminar airflow duct, such a system therefore may have a group of two or more concentric regions of regional airflow velocity, with the innermost of these regions having the highest regional airflow velocity and the outermost one having the lowest regional airflow velocity. Since the regional airflow velocities can be measured accurately and the droplet emission speeds adapted, the timing of the emission of the inkjet fluid droplets may be made intentionally different amongst the different regions to compensate for the variation in regional airflow velocity amongst member regions of the group. In this cylindrical embodiment, the nozzles from which the inkjet fluid droplets are emitted will clearly be arranged in concentric circles.

In a further embodiment of the invention, an airflow duct of non-uniform cross section may be constructed to obtain a regional airflow velocity that is substantially collinear to the drop trajectory. Although airflow collinear with the intended drop trajectory may be obtained with laminar flow in a duct of fixed cross section across the flow direction, a substantially collinear flow may exist in an airflow duct with changing cross section along the direction of flow. In one particular embodiment, said duct may be formed by two planes as in the rectangular duct of FIG. 1, but with planes 8 and 9 being non-parallel and decreasing in separation toward the recording surface. This converging duct may still maintain laminar flow but will have airflow velocity that is increasing in magnitude and may change in direction toward the outlet at the recording surface. Drops are directed into this substantially collinear airflow duct such that on average the relative velocity between the drops and the converging airflow is sufficiently small to reduce aerodynamic interactions to the level where improved drop placement accuracy on the recording surface is obtained.

In yet another particular embodiment, the duct may be formed by two planes as in the rectangular duct of FIG. 1, but with planes 8 and 9 being non-parallel and increasing in separation toward the recording surface. This described diverging duct may still maintain laminar flow but will have airflow velocity that is changing in direction and decreasing in magnitude toward the outlet at the recording surface. Drops are directed into this airflow such that on average the relative velocity between said drops and the converging airflow is sufficiently small as described above.

The use of multiple regional airflow velocities may be extended to the other configurations described herein. In the case of a laminar airflow duct having a rectangular configuration, the inkjet nozzles might be arranged in a plurality of parallel rows in order to eject their inkjet fluid droplets into the various regional airflow velocity zones. In an embodiment having a laminar airflow duct of more generalized cross-section, the arrangement of the nozzles might be correspondingly more generalized to ensure that a given subset of nozzles emit their inkjet fluid droplets into a region of substantially matched regional airflow velocity.

Some embodiments of the invention include multiple groups or rows of nozzles arranged symmetrically or asymmetrically with respect to the laminar profile of the airflow within a duct. In other words, an even number of rows or groups of nozzles may be equally spaced and centrally positioned with respect to the laminar air velocity profile created by a given duct. In such embodiments, the regions of sub-maximal airflow velocity into which the droplets are emitted will be the same on both sides of the laminar profile of the airflow.

In alternative embodiments, an even or odd set of nozzles may be evenly or unevenly spaced and asymmetrically positioned with respect to the laminar profile created by a given duct. In such embodiments, the regions of sub-maximal airflow into which the droplets are emitted may be different on each side of the laminar profile of the airflow, and may even be confined solely to one side of the laminar profile. Obviously, in all of the above embodiments, the droplet velocity at which any given droplets are emitted from any given nozzle, groups of nozzles or rows of nozzles should be controlled to match the sub-maximal airflow velocity of the respective regions of sub-maximal airflow into which the given droplets are emitted.

While the different embodiments of the invention described above are based on continuous inkjet systems, the several advantages of the invention apply equally to drop-on-demand inkjet systems, where inkjet fluid droplets are emitted only when they are intended to print onto the media being printed upon. Such systems therefore have no requirement for guttering and all emitted inkjet fluid droplets travel within the collinear flow of air. Drop-on-demand systems are particularly amenable to implementations in which more than one regional airflow velocity is selected for inkjet fluid droplet injection.

There have thus been outlined the important features of the invention in order that it may be better understood, and in order that the present contribution to the art may be better appreciated. Those skilled in the art will appreciate that the conception on which this disclosure is based may readily be utilized as a basis for the design of other methods and apparatus for carrying out the several purposes of the invention. It is most important, therefore, that this disclosure be regarded as including such equivalent methods and apparatus as do not depart from the spirit and scope of the invention.

As will be apparent to those skilled in the art in the light of the foregoing disclosure, many alterations and modifications are possible in the practice of this invention without departing from the spirit or scope thereof. For example:

the airflow may be provided by gases other than air;

the air flow may have some minor turbulence which does not unduly affect print quality and still comprise a laminar velocity profile;

the air flow may also vary in a direction perpendicular to the plane of the figures as would be the case, for example where the airflow is established within a duct having an elliptical cross section.

Accordingly, the scope of the invention is to be construed in accordance with the substance defined by the following claims.

What is claimed is:

1. A method for depositing fluid droplets on a surface, the method comprising:

establishing a flow of air in a first direction substantially collinear with a trajectory of fluid droplets emitted by each of one or more droplet emitters, the flow of air having a velocity profile characterized by a maximum airflow velocity; and emitting at least one fluid droplet from each of the droplet emitters into a first region of the flow of air which is spaced apart from a location of the maximum airflow velocity in a direction transverse to the first direction, the first region having a first regional airflow velocity lower than the maximum airflow velocity.

2. A method according to claim 1, comprising substantially matching a velocity at which the at least one fluid droplet is emitted into the first region with the first regional airflow velocity.

3. A method according to claim 1 wherein emitting at least one fluid droplet from each of the droplet emitters into the first region comprises emitting fluid droplets from a plurality of nozzles into the first region.

4. A method according to claim 1 wherein emitting at least one fluid droplet from each of the droplet emitters into the first region comprises emitting the at least one fluid droplet from a first nozzle into the first region and wherein the method comprises emitting at least one additional fluid droplet from a second nozzle into a second region of the flow of air, the second region having a second regional airflow velocity lower than the maximum airflow velocity.

5. A method according to claim 4 wherein at least a portion of the first region and at least a portion of the second region are on opposed sides of the location of the maximum airflow velocity.

6. A method according to claim 5 wherein the first and second regions are symmetrically disposed with respect to the location of the maximum airflow velocity.

7. A method according to claim 5 wherein the first and second regional airflow velocities are equal to one another.

8. A method according to claim 5 comprising substantially matching a velocity at which the at least one fluid droplet is emitted into the first region with the first regional airflow velocity and substantially matching a velocity at which the at least one additional fluid droplet is emitted into the second region with the second regional airflow velocity.

9. A method according to claim 4 wherein the first and second regional airflow velocities are different from one another.

10. A method according to claim 4 wherein the flow of air has a first velocity gradient in the first region and a second velocity gradient in the second region.

11. A method according to claim 1 wherein emitting at least one fluid droplet from each of the droplet emitters into the first region comprises emitting the at least one fluid droplet from at least one first row of a plurality of rows of nozzles into the first region and wherein the method comprises emitting at least one additional fluid droplet from at least one second row of the plurality of rows of nozzles into a second region of the flow of air, the second region having a second regional airflow velocity lower than the maximum airflow velocity.

12. A method according to claim 11 wherein at least a portion of the first region and at least a portion of the second region are on opposed sides of the location of the maximum airflow velocity.

13. A method according to claim 12 wherein the first and second regions are symmetrically disposed with respect to the location of the maximum airflow velocity.

14. A method according to claim 12 wherein the first and second regional airflow velocities are equal to one another.

15. A method according to claim 12 comprising substantially matching a velocity at which the at least one fluid droplet is emitted into the first region with the first regional airflow velocity and substantially matching a velocity at which the at least one additional fluid droplet is emitted into the second region with the second regional airflow velocity.

16. A method according to claim 11 wherein the first and second regional airflow velocities are different from one another.

17. A method according to claim 1 wherein establishing the flow of air comprises forcing air past at least one surface and wherein the first region is between the at least one surface and the location of the maximum airflow velocity.

18. A method according to claim 1 wherein the flow of air is established in a duct which is substantially round in cross-section.

19. A method according to claim 1 wherein the flow of air is established between a pair of opposed surfaces that converge as they extend in a direction of the flow of air.

20. A method according to claim 1 wherein the flow of air has a first velocity gradient in the first region.

21. An apparatus for depositing fluid droplets on a surface, the apparatus comprising:

an airflow duct;

means for establishing in the airflow duct a collinear airflow in a first direction, the collinear airflow comprising:

(a) an airflow velocity profile with a maximum airflow velocity; and (b) a first region transversely spaced apart from a location of the maximum airflow velocity in a direction transverse to the first direction, wherein the collinear airflow has a first regional airflow velocity in the first region, which is lower than the maximum airflow velocity; and at least one nozzle disposed to emit fluid droplets into the first region in the first direction.

22. The apparatus of claim 21, comprising a systems controller configured to at least substantially match a fluid droplet velocity of the emitted fluid droplets and the first regional airflow velocity.

23. Apparatus according to claim 21 wherein the collinear airflow comprises a second region wherein the collinear airflow has a second regional airflow velocity which is lower than the maximum airflow velocity and wherein the apparatus comprises a first group of one or more nozzles disposed to emit fluid droplets into the first region in the first direction and a second group of one or more nozzles disposed to emit fluid droplets into the second region in the first direction.

24. Apparatus according to claim 23 wherein at least a portion of the first region and at least a portion of the second region are located on opposed sides of the location of the maximum regional airflow velocity.

25. Apparatus according to claim 24 wherein the first and second regions are symmetrically disposed with respect to the location of the maximum regional airflow velocity.

26. Apparatus according to claim 24 wherein the first and second regional airflow velocities are substantially equal to one another.

27. Apparatus according to claim 24, comprising one or more systems controllers, the one or more systems controllers configured to respectively match a fluid droplet velocity of the fluid droplets emitted by the first and second groups of nozzles with the first and second regional airflow velocities.

28. Apparatus according to claim 23 wherein the first and second regional airflow velocities are different from one another.

29. Apparatus according to claim 21 wherein the collinear airflow comprises a second region wherein the collinear airflow has a second regional airflow velocity which is lower that the maximum airflow velocity and wherein the apparatus comprises a first row of nozzles arranged to emit fluid droplets into the first region in the first direction and a second row of nozzles arranged to emit fluid droplets into the second region in the first direction.

30. Apparatus according to claim 29 wherein at least a portion of the first region and at least a portion of the second region are located on opposed sides of the location of the maximum airflow velocity.

31. Apparatus according to claim 30 wherein the first and second regions are symmetrically disposed with respect to the location of the maximum airflow velocity.

32. Apparatus according to claim 30 wherein the first and second regional airflow velocities are substantially equal to one another.

33. Apparatus according to claim 29 wherein the first and second regional airflow velocities are different from one another.

34. Apparatus according to claim 30, comprising one or more systems controllers, the one or more systems controllers configured to respectively match the fluid droplet velocity of the fluid droplets emitted by the first and second rows of nozzles with the first and second regional airflow velocities.

35. Apparatus according to claim 21 wherein the airflow duct comprises a substantially round cross-section.

36. Apparatus according to claim 21 wherein the airflow duct comprises a pair of opposed surfaces which converge as they extend in a direction of the airflow.

37. A method for depositing fluid droplets on a surface, the method comprising:

establishing a flow of air substantially collinear with a trajectory of fluid droplets emitted by a plurality of groups of nozzles; and emitting the fluid droplets from the plurality of groups of nozzles into a plurality of regions of the flow of air, the plurality of regions each having a regional airflow velocity lower than a maximum airflow velocity of the flow of air and the plurality of regions each having a different regional airflow velocity for each of the plurality of regions, substantially matching a velocity at which the fluid droplets are emitted into the region with the regional airflow velocity of the region.

38. An apparatus for depositing fluid droplets on a surface, the apparatus comprising:

a collinear airflow duct for establishing a collinear airflow, the collinear airflow duct adapted to provide an airflow velocity profile within the collinear airflow, the airflow velocity profile having:

(a) a maximum airflow velocity; and (b) a plurality of regions of regional airflow velocity, the regional airflow velocity being:

(i) lower than the maximum airflow velocity; and (ii) different in all the regions of regional airflow velocity; and a plurality of groups of inkjet nozzles disposed to emit fluid droplets into the regions of regional airflow velocity, each group of inkjet nozzles within the plurality of groups of inkjet nozzles capable of emitting fluid droplets into a different region of regional airflow velocity at an inkjet fluid droplet velocity.

39. The apparatus of claim 38 further comprising one or more systems controllers configured to at least substantially match a fluid droplet velocity provided by a member group of the plurality of groups of inkjet nozzles and a regional airflow velocity of one of the plurality of regions of regional airflow velocity.

40. An apparatus for depositing fluid droplets on a surface, the apparatus comprising:

means for establishing a collinear airflow having an airflow velocity profile within the collinear airflow, the airflow velocity profile having:

(a) a maximum airflow velocity; and (b) a plurality of regions of regional airflow velocity, the regional airflow velocity being:

(i) lower than the maximum airflow velocity; and (ii) different in all the regions of regional airflow velocity; and means for emitting fluid droplets into each of the plurality of regions of regional airflow velocity at an inkjet fluid droplet velocity.

* * * * *